US007695295B2

(12) United States Patent
Hanyu

(10) Patent No.: US 7,695,295 B2
(45) Date of Patent: Apr. 13, 2010

(54) FLAT CIRCUIT CONNECTOR

(75) Inventor: Takuji Hanyu, Tokyo (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/661,560

(22) PCT Filed: Aug. 3, 2005

(86) PCT No.: PCT/US2005/027471

§ 371 (c)(1),
(2), (4) Date: Mar. 24, 2008

(87) PCT Pub. No.: WO2006/026036

PCT Pub. Date: Mar. 9, 2006

(65) Prior Publication Data

US 2008/0261422 A1 Oct. 23, 2008

(30) Foreign Application Priority Data

Aug. 31, 2004 (JP) ..... 2004-251320

(51) Int. Cl.
*H01R 13/62* (2006.01)

(52) U.S. Cl. ..... 439/153; 439/108; 439/492

(58) Field of Classification Search ..... 439/492, 439/494, 495, 497, 579, 260, 108, 721, 153
See application file for complete search history.

(56) References Cited

U.S. PATENT DOCUMENTS 5,281,762 A 1/1994 Long et al.
5,319,523 A 6/1994 Ganthier et al.
6,435,892 B1 8/2002 Billman
6,811,439 B1 * 11/2004 Shin-Ting ..... 439/607
6,830,478 B1 * 12/2004 Ko ..... 439/579
6,863,559 B2 * 3/2005 Yu ..... 439/497
2004/0072467 A1 4/2004 Jordan et al.
2004/0115987 A1 6/2004 Yu

FOREIGN PATENT DOCUMENTS

WO WO 2004/040712 A1 5/2004

* cited by examiner

*Primary Examiner*—Tho D Ta
*Assistant Examiner*—Travis Chambers
(74) *Attorney, Agent, or Firm*—Timothy M. Morella

(57) ABSTRACT

An electrical connector is provided for mounting on a printed circuit board and for terminating a flat electrical circuit. The connector includes a dielectric housing for mounting on a printed circuit board and having an opening at a front portion thereof for receiving an end of the flat circuit. A mounting slot is provided at the front portion of the housing. A plurality of terminals are mounted on the housing and are spaced along the opening. A grounding retention member is mounted at the front of the housing and includes a locking portion, a grounding portion and a terminal portion. The locking portion is insertable into the mounting slot at the front portion of the housing. The grounding portion secures the connector to a ground circuit on the printed circuit board. The terminal portion engages a ground conductor on the flat circuit inserted into the opening at the front of the housing.

9 Claims, 3 Drawing Sheets

FLAT CIRCUIT CONNECTOR

FIELD OF THE INVENTION

This invention generally relates to the art of electrical connectors and, particularly, to a connector for terminating a flat circuit, such as a flat flexible circuit, a flexible printed circuit or other flat electrical cable. The connector is provided for mounting on a printed circuit board, and means are provided for grounding the flat circuit to the printed circuit board.

BACKGROUND OF THE INVENTION

A wide variety of electrical connectors have been designed for terminating flat cables or circuits, such as flat flexible cables, flexible printed circuits or the like. A typical connector for flat circuits includes a dielectric housing molded of plastic material, for instance. The housing has an elongated opening or slot for receiving an end of the flat circuit which has generally parallel, laterally spaced conductors exposed across the end. A plurality of terminals are mounted in the housing and are spaced laterally along the slot, with contact portions of the terminals engageable with the laterally spaced conductors of the flat circuit. An actuator often is movably mounted on the housing for movement between a first position whereat the flat circuit is freely insertable into the slot and a second position whereat the actuator clamps the circuit in the housing and biases the circuit against the contact portions of the terminals.

The actuator may comprise a slide member which is designed to be inserted into the insertion opening together with the flat circuit and to press the contact portions of the terminals against the flat circuit and prevent removal thereof. For example, see Japanese Patent Application Laid-Open No. H7-326439.

In the connector disclosed in the above publication, a grounding conductive member is attached to the connector housing for forming a ground circuit opposite the terminals. When the contact portions of the terminals are pressed against the conductors of the flat circuit, the grounding conductive member comes into contact with a ground conductor of the flat circuit to ground the circuit to a printed circuit board. The grounding conductive member discharges electric charges and eliminates the adverse effect of noise on various pieces of equipment and other associated electronic devices.

However, problems are encountered with grounding systems as described above, because the grounding conductive member comes into contact with the ground conductor of the flat circuit at a position substantially coincident with the position where the contact portions of the connector terminals come into contact with the signal traces on the flat circuit, with respect to the insertion direction of the flat circuit. Because of the proximity of these positions, noise may be generated from electrical charges.

In addition, the grounding conductive member is soldered to grounding lands on the printed circuit board directly under the connector housing. Therefore, the solder connections cannot be inspected and repaired if defective. The present invention is directed to solving these various problems.

SUMMARY OF THE INVENTION

An object, therefore, of the invention is to provide a flat circuit connector of the character described and including a new and improved grounding connection between the flat circuit and a printed circuit board.

In the exemplary embodiment of the invention, a flat circuit connector includes a dielectric housing for mounting on a printed circuit board and having an opening at a front portion thereof for receiving an end of a flat circuit. A mounting slot is provided at the front portion of the housing. A plurality of terminals are mounted on the housing and are spaced along the opening. A grounding retention member is mounted at the front of the housing and includes a locking portion, a grounding portion and a terminal portion. The locking portion is insertable into the mounting slot at the front portion of the housing. The grounding portion secures the connector to a ground circuit on the printed circuit board. The terminal portion engages a ground conductor on the flat circuit inserted into the opening at the front of the housing.

The connector may include an actuator movably mounted on the housing. The actuator moves between an open position allowing the end of the flat circuit to be inserted into the opening and a closed position to relatively bias the flat circuit against the terminals.

As disclosed herein, the locking portion of the grounding retention member comprises a locking finger projecting into the mounting slot at the front of the housing in the direction of insertion of the flat circuit into the opening. The terminal portion of the retention member comprises a flexible terminal tab bent into the opening at the front portion of the housing. The grounding portion of the retention member comprises a grounding finger projecting forwardly of the housing.

The grounding retention member includes a base portion disposed beneath the front portion of the housing. The locking portion, the grounding portion and the terminal portion of the retention member all project from a front edge of the base portion. In the preferred embodiment, the base portion of the retention member is elongated and includes a plurality of the locking portions, the grounding portions and the terminal portions spaced along the elongated base portion.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
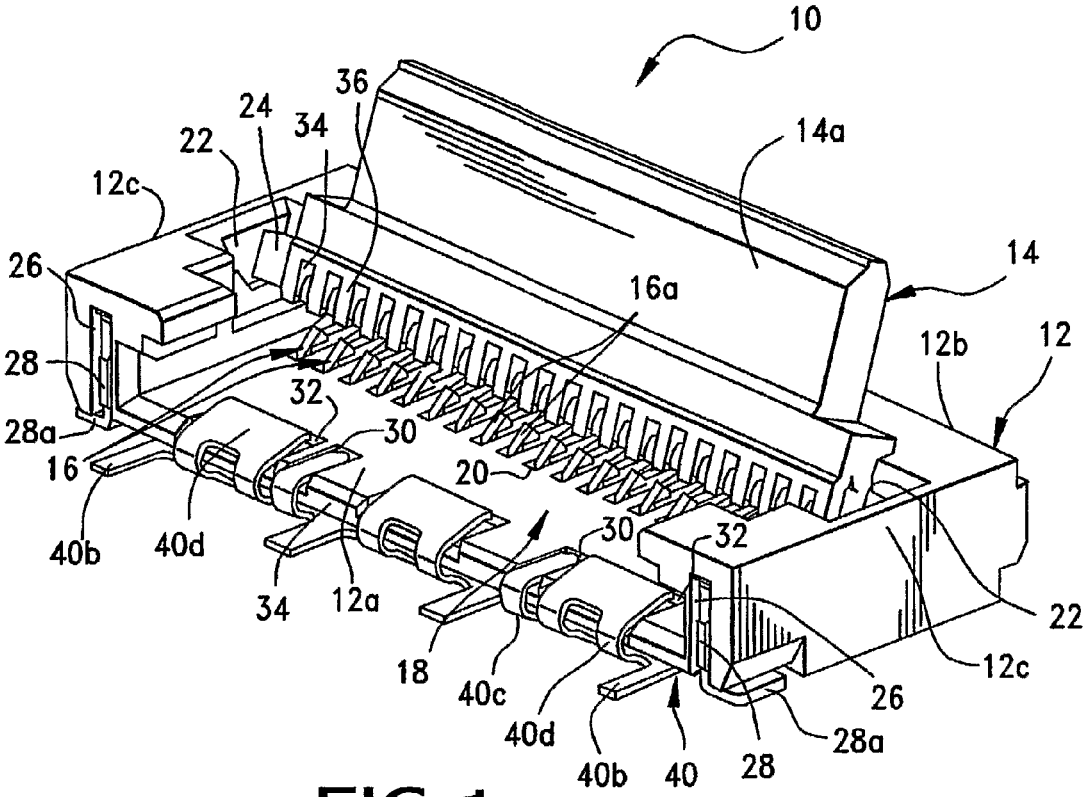
FIG. 1 is a top, front perspective view of a flat circuit connector according to the invention, with the actuator pivoted to its open position.
Figure 2:
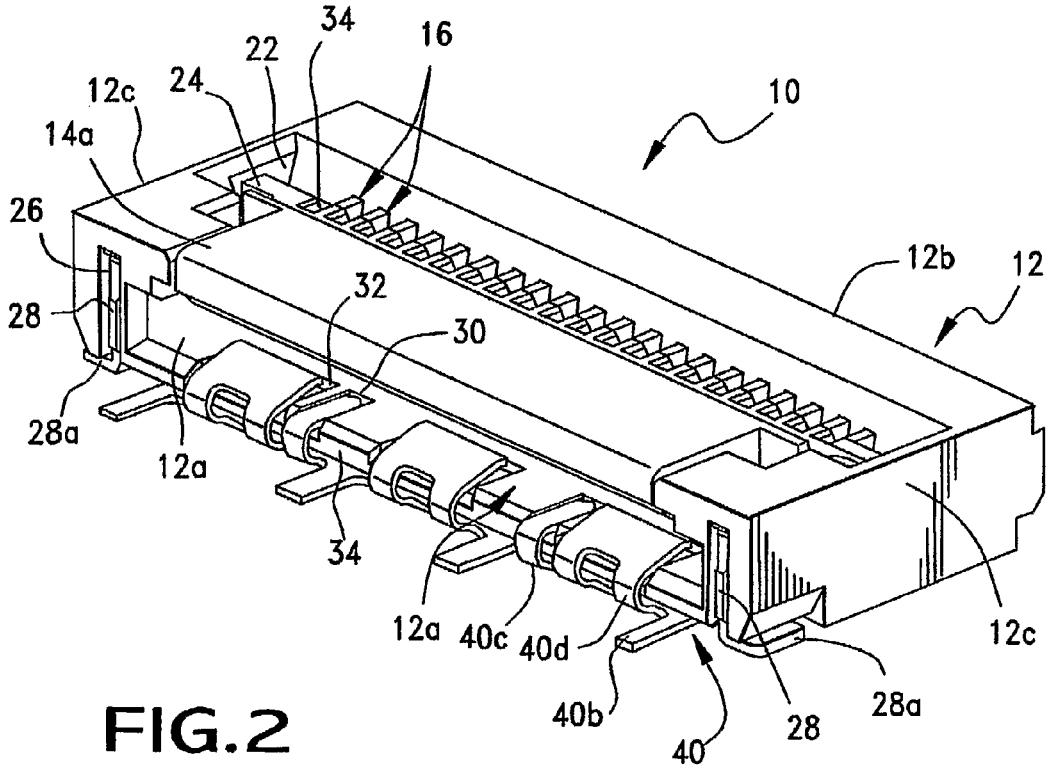
FIG. 2 is a perspective view similar to that of FIG. 1, with the actuator pivoted to its closed position.

Referring to the drawings in greater detail, FIGS. 1 and 2 show a flat circuit connector, generally designated 10, according to an exemplary embodiment of the invention. The connector is configured for mounting on a printed circuit board (described hereinafter), and the connector is provided for terminating a flat electrical circuit (also described hereinafter). The term "flat circuit" herein and in the claims hereof is intended to refer to all kinds of flat electrical cables, including but not limited to flat flexible circuits, flexible printed circuit boards, flat rigid and flexible cables or the like. The connector includes two main components, namely an elongated dielectric housing, generally designated 12, and an elongated actuator, generally designated 14, movably mounted on the housing, along with a plurality of terminals, generally designated 16, mounted on the housing in a side-by-side array longitudinally thereof.

Actuator 14 is pivotally mounted relative to housing 12 for pivotal movement between an open position (FIG. 1) allowing an end of the flat circuit to be inserted into the connector and a closed position (FIG. 2) to bias the flat circuit against contact portions 16*a* of terminals 16. The housing and/or actuator define an elongated circuit insertion opening, generally designated 18, at the front of the housing for receiving the end of the flat circuit for termination to contact portions 16*a* of terminals 16. As will be seen hereinafter, the flat circuit has spaced conductors laterally thereof. Each of the housing 12 and the actuator 14 may be a one-piece structure unitarily molded of dielectric material such as plastic or the like. The terminals typically are stamped and formed of sheet metal material.

More particularly, housing 12 has a lower front portion 12*a*, an upper rear portion 12*b* and opposite end walls 12*c* all combining to define circuit insertion opening 18. A plurality of terminal-receiving grooves 20 are formed along insertion opening 18 for mounting terminals 16 therein. In the illustrated embodiment, the terminal-receiving grooves are formed at a pitch of, for example, approximately 0.5 mm, with a single terminal 16 inserted into each groove. Terminals 16 are not necessarily required to be positioned in all of the terminal-receiving grooves, in that some of the terminals may be omitted in accordance with the arrangement of the conductors on the flat circuit.

A pair of upwardly opening, bearing recessed areas 22 are formed inside end walls 12*c* of the housing for receiving pivoting shafts 24 which project outwardly from opposite ends of actuator 14. A pair of slots 26 open at the front of end walls 12*c* for receiving a pair of fitting nails 28. The fitting nails are fabricated of metal material and include feet portions 28*a* which project outwardly relative to the housing for connection to appropriate mounting pads on the printed circuit board, as by soldering, to secure the housing to the board.

Finally, a pair of mounting slots 30 and three recesses 32 are formed in lower front portion 12*a* of housing 12. Slots 30 and recesses 32 alternate along insertion opening 18, and the slots and recesses open through a front face 34 of the lower front portion of the housing at the front of the insertion opening.

Actuator 14 includes a main body portion 14*a* which also is elongated to extend along the elongated insertion opening 18. It can be seen in FIG. 2 that main body portion 14*a* has a length to fit between ends walls 12*c* of housing 12 when the actuator pivots downwardly from its open position (FIG. 1) to its closed (FIG. 2). It can be seen in FIG. 1 that actuator 14 has a plurality of slots 34 separated by partition walls 36. Slots 34 are aligned with terminal-receiving grooves 20 in housing 12. As stated above, positioning shafts 24 at opposite ends of actuator 14 project into the bearing recessed areas 22 inside the end walls 12*c* of the housing.

Figure 3:
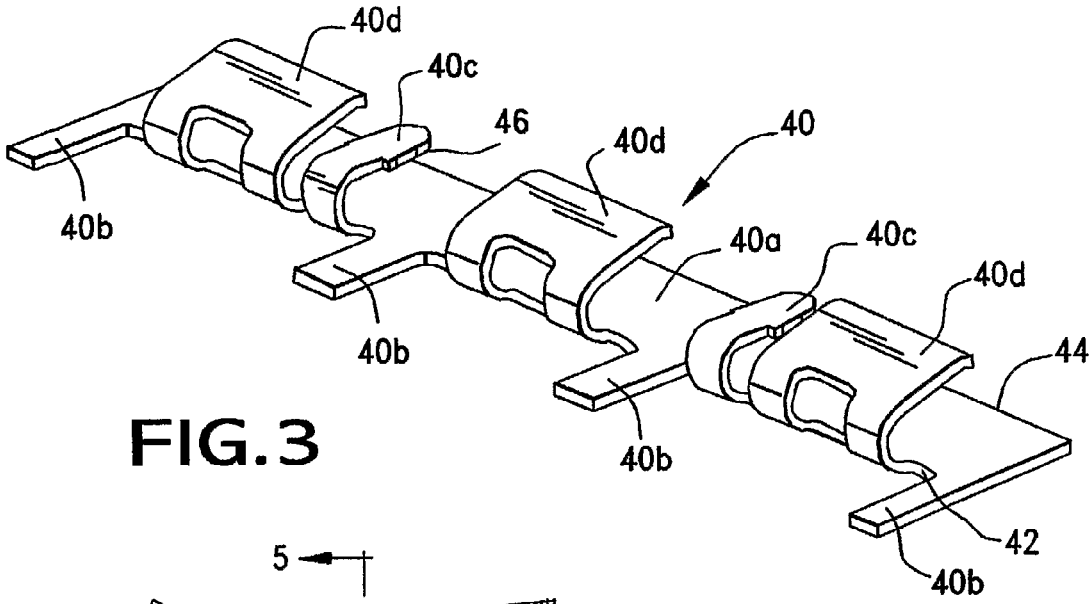
FIG. 3 is a front perspective view of the grounding retention member.

Referring to FIG. 3 in conjunction with FIGS. 1 and 2, a grounding retention member, generally designated 40, is mounted along front face 34 of the lower front portion 12*a* of housing 12. The grounding retention member is elongated and extends along insertion opening 18. The retention member is stamped and formed of flexible or spring metal material. The grounding retention member includes an elongated base portion 40*a* which is generally planar and extends rearwardly from front face 34 beneath housing 12. The base portion has a front edge 42 and a rear edge 44. Four grounding portions 40*b* project forwardly of front edge 42 and are coplanar with base portion 40*a*. The grounding portions comprise grounding fingers for connection, as by soldering, to appropriate ground circuits or pads on the printed circuit board. With the grounding fingers projecting forwardly of front face 34 of the housing as seen in FIGS. 1 and 2, the solder connections with the circuit board can easily be inspected.

Grounding retention member 40 includes two locking portions 40*c* which project into mounting slots 30 to secure the retention member to housing 12. The locking portions are in the form of fingers which are bent from front edge 42 back over base portion 40*a* for insertion into mounting slots 30. The locking fingers have barbs 46 which bight into the plastic material at the sides of mounting slots 30 to fix retention member to housing 12.

Grounding retention member 40 also includes three terminal portions 40*d* for engaging ground conductors on the flat circuit when the circuit is inserted into opening 18. The terminal portions are formed by flexible terminal tabs which are bent from edge 42 back over base portion 40*a* of the retention member. Terminal tabs 40*d* are aligned above recesses 32 and are spaced above the top surface of front portion 12*a* of the housing so that the terminal tabs can flex downwardly when engaging the flat circuit. In other words, recesses 32 accommodate flexing of terminal tabs 40*d*.

Figure 4:
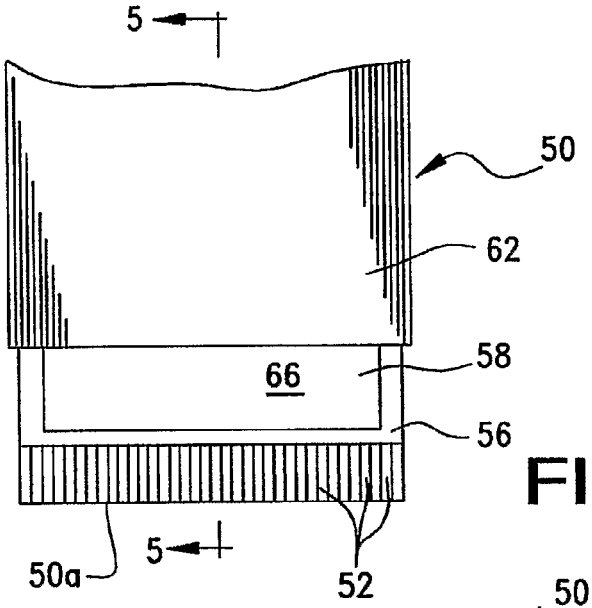
FIG. 4 is a fragmented plan view of an end of a flat circuit used in the connector of the invention.

FIG. 4 is a plan view of an end of a flat circuit, generally designated 50, for insertion into insertion opening 18 of connector 10. The flat circuit has a leading end 50*a*. This view actually is a bottom plan view of the flat circuit in relation to the orientation of the circuit as it would be inserted into opening 18 when connector 10 is oriented as shown in FIGS. 1 and 2. The flat circuit is turned over to the orientation as shown in FIG. 5 before insertion into the connector.

Figure 5:
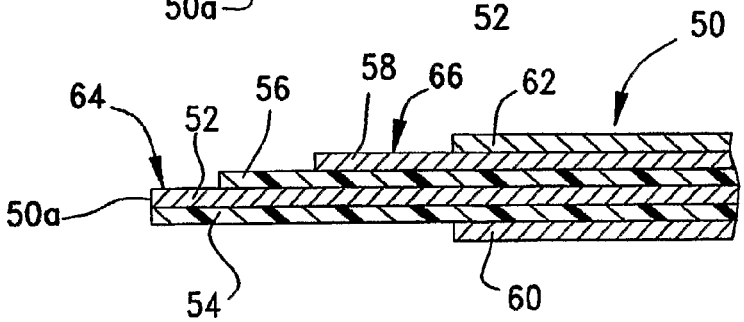
FIG. 5 is a vertical section taken generally along line 5-5 in FIG. 4.

With that understanding, and referring to FIG. 5 in conjunction with FIG. 4, flat circuit 50 includes a plurality of signal conductors 52 which are sandwiched between a pair of first and second insulating layers 54 and 56, respectively. A ground layer 58 of electrically conductive metal is disposed on second insulating layer 56. A first shield layer 60 is disposed on first insulating layer 54, and a second shield layer 62 is disposed on ground layer 58. It can be seen in the drawings that, while first insulating layer 52 completely covers one side of signal conductors 52, second insulating layer 56 is shorter than the conductors to expose distal ends of the conductors, as at 64 (FIG. 5). The distal end of ground layer 58 is set back from the end of second insulating layer 56, and the second shield layer 62 is shorter than the ground layer to expose a distal end of the ground layer, as at 66.

Figure 6:
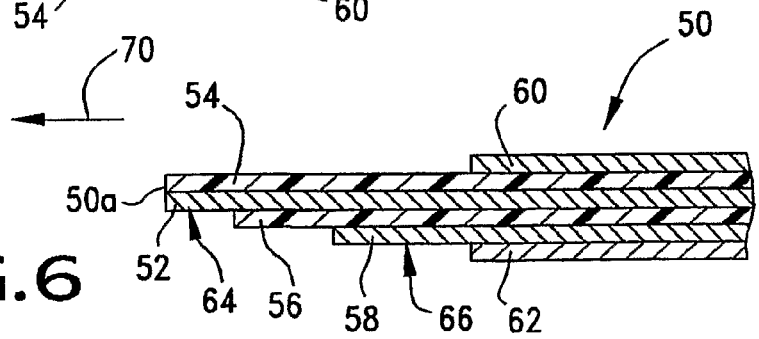
FIG. 6 is a view similar to that of FIG. 5, with the flat circuit turned upside-down relative to the orientation in FIG. 5.

FIG. 6 shows flat circuit 50 turned upside-down relative to the orientation of FIGS. 4 and 5, to show the orientation of the flat circuit when it is inserted into opening 18 in the direction of arrow 70 (FIG. 6). It can be seen that the distal ends 64 of signal conductors 52 are exposed immediately adjacent the leading end 50*a* of the flat circuit whereby the conductors will engage contact portions 16*a* (FIG. 1) of terminals 16 when the flat circuit is inserted into opening 18. Signal conductors 52 are at a pitch of 0.5 mm corresponding to that of terminals 16. The distal end 66 of ground layer 58 is exposed at a position spaced from the leading end 50*a* of the flat circuit. In other words, the engaging area of ground layer 50 with the ground conductor(s) of the flat circuit is located remote from the engagement area of signal conductors 52 with contact portions 16*a* of terminals 16. Therefore, with the grounding interface of the connector being spaced or remote from the signal interface of the connector, noise from the grounding interface will not be generated in the signal connections.

Figure 7:
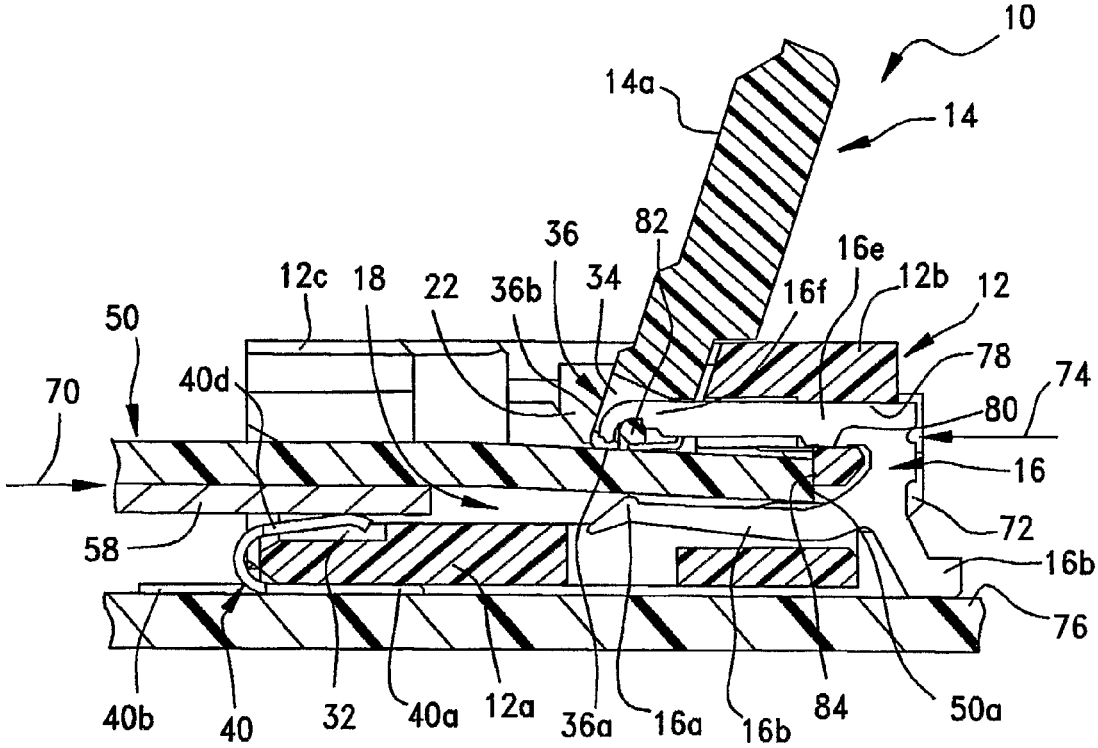
FIG. 7 is an enlarged, front-to-rear vertical section through the connector receiving the flat circuit and with the actuator in its open position of FIG. 1.

FIG. 7 shows flat circuit 50 inserted into opening 18 of connector 10, with actuator 14 in its open position. Signal terminals 16 are inserted into a plurality of terminal-receiving passages 72 at the rear of housing 12 in the direction of arrow 74. Each signal terminal includes a contact spring arm 16*b* at the bottom of insertion opening 18. Contact portion 16*a* of the terminal projects upwardly at the distal end of the contact spring arm. FIG. 7 shows connector 10 mounted on a printed circuit board 76, and the terminals include tail portions 16*d* for surface connection, as by soldering, to appropriate circuit traces on the printed circuit board. Each terminal has an upper rigid arm 16*e* which projects forwardly above insertion opening 18 and terminates in a hooked pivot end 16*f*. Rigid arm 16*e* is press-fit between a pair of upper and lower bearing surfaces 78 and 80, respectively, of the terminal-receiving passages 72 to fix the terminal within housing 12. With pivot shafts 24 (FIG. 1) resting in recesses 24, and with the hooked pivot ends 16*f* of the terminals opening downwardly, actuator 14 is captured on housing 12 and cannot be lifted therefrom.

Still referring to FIG. 7, partition walls 36 which separate slots 34 define a plurality of pressing ribs of the actuator. The pressing ribs have first pressing surface 36*a* and second pressing surface 36*b*. Integral pivot pin portions 82 of actuator 14 span slots 34 between pressing ribs 36, and the pivot pin portions seat within the hooked pivot ends 16*f* of signal terminals 16.

With actuator 14 in its open position as shown in FIG. 7, flat circuit 50 is inserted into opening 18 in the direction of arrow 70 until leading end 50*a* of the flat circuit abuts against an interior wall 84 of housing 12. First pressing surfaces 36*a* of pressing ribs 36 are parallel to the insertion direction of the flat circuit and apply little or no pressure on the flat circuit so that the flat circuit can be easily inserted into the connector. When the flat circuit is fully inserted, signal conductors 52 (FIGS. 4-6) at the extreme distal end of the flat circuit will be aligned with contact portions 16*a* of signal terminals 16. Ground layer 58 of the flat circuit will be aligned with terminal tabs 40*d* of the grounding retention member 40. It can be seen that the grounding interface of terminal tabs 40*d* with ground layer 58 is at the extreme front of the connector while the signal interface of contact portions 16*a* with the signal terminals of the flat circuit is remote therefrom at the extreme inner end of insertion opening 18. Therefore, the grounding retention member can dissipate electrical charges without generating noise in the signal circuits.

Figure 8:
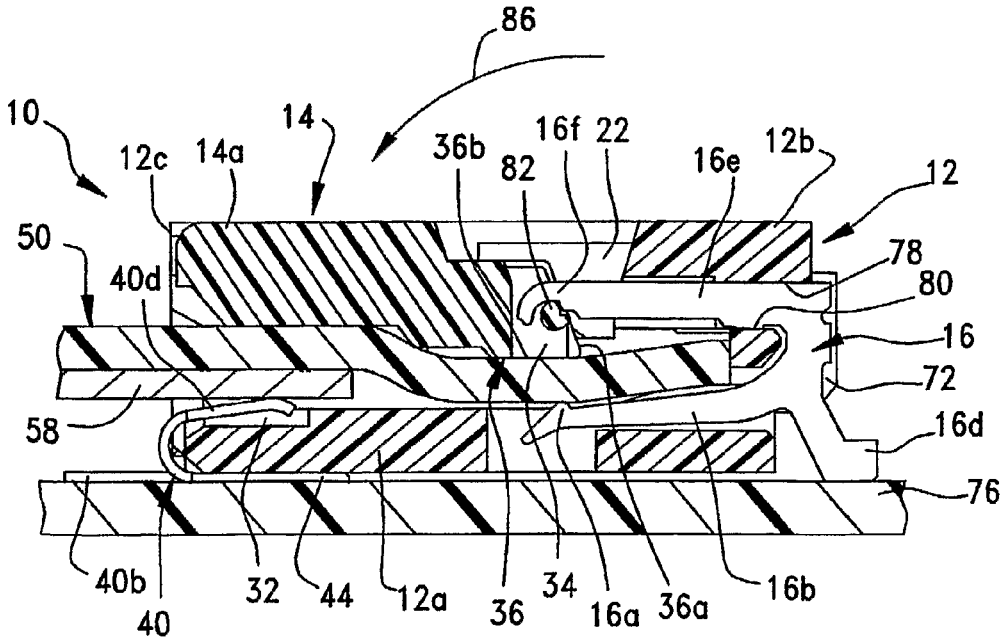
FIG. 8 is a view similar to that of FIG. 7, with the actuator in its closed position of FIG. 2.

FIG. 8 shows actuator 14 pivoted downwardly in the direction of arrow 86 to its closed position. In its closed position, pressing surfaces 36*b* of pressing ribs 36 bias flat circuit 50 into engagement with contact portions 16*a* of signal terminals 16, flexing the contact spring arms 16*b* downwardly to provide a positive conductive engagement between contact portions 16*a* and signal conductors 52 (FIGS. 3-6) of the flat circuit. The actuator also maintains ground layer 58 of the flat circuit in engagement with terminal tabs 40*d* of the grounding retention member 40.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for mounting on a printed circuit board and for terminating a flat electrical circuit, comprising:

an elongated dielectric housing for mounting on the circuit board, the housing having an elongated opening at a front portion thereof, for receiving an end of the flat circuit, a rear portion opposite the front portion, and a mounting slot at the front portion of the housing;

a plurality of terminals mounted on the housing and spaced along the opening, each terminal having a tail portion, positioned along the rear portion for connection to an appropriate trace on the circuit board, and a contact portion extending along the elongated opening for engaging an appropriate conductor on the flat circuit; and a grounding and retention member positioned adjacent the front portion of the housing, the grounding and retention member including:

an elongated base portion disposed beneath the front portion of the housing;

a locking finger bent back from a front edge of the base portion and projecting into the mounting slot in the direction of insertion of the flat circuit into the elongated opening;

a grounding finger projecting forwardly of the housing for securing the connector to a ground circuit on the printed circuit board; and a flexible terminal tab bent back from the front edge of the base portion into the elongated opening at the front portion of the housing for engaging a ground conductor on the flat circuit inserted into the elongated opening.

2. The electrical connector of claim 1, including a plurality of said locking fingers, a plurality of said grounding fingers and a plurality of said flexible terminal tabs spaced along the elongated base portion.

3. The electrical connector of claim 2, wherein the grounding and retention member further comprises a plurality of grounding fingers projecting forwardly of the housing.

4. An electrical connector for mounting on a printed circuit board and for terminating a flat electrical circuit, comprising:

a dielectric housing for mounting on the circuit board, the housing having a front portion, a rear portion opposite the front portion, and an opening at the front portion thereof for receiving an end of the flat circuit;

a plurality of terminals mounted on the housing, each terminal having a tail portion, positioned along the rear portion for connection to an appropriate trace on the circuit board, and a contact portion extending along the opening for engaging an appropriate conductor on the flat circuit; and a unitarily formed grounding and retention member positioned adjacent the front portion of the housing, the grounding and retention member including:

a plurality of grounding fingers for securing the connector to ground circuits on the circuit board and extending along the front portion of the housing; and a plurality of terminal portions each for engaging a ground conductor on the flat circuit upon insertion of the flat circuit into the opening.

5. The electrical connector of claim 4, wherein the grounding fingers project forwardly of the housing.

6. The electrical connector of claim 4, wherein the grounding and retention member further includes a locking portion including a locking finger projecting into a mounting slot in the opening.

7. The electrical connector of claim 4, wherein the terminal portions of the grounding and retention member comprise a plurality of flexible terminal tabs bent into the opening at the front portion of the housing.

8. The electrical connector of claim 4, wherein the grounding and retention member is elongated and further includes an elongated base portion, a plurality of locking portions and a plurality of grounding portions.

9. The electrical connector of claim 4, wherein the grounding and retention member further includes an elongated base portion, from which both a plurality of locking fingers and a plurality of the grounding portions extend, and a plurality of said terminal portions spaced along the elongated base portion.

* * * * *